US010066181B1

(12) United States Patent
Swift et al.

(10) Patent No.: US 10,066,181 B1
(45) Date of Patent: Sep. 4, 2018

(54) METHODS OF USING A DRY LUBRICANT

(75) Inventors: Philip Swift, Weston, FL (US); Alan Swift, Coral Springs, FL (US)

(73) Assignee: Swift Maintenance Products, Inc., Coral Springs, FL (US)

( * ) Notice: Subject to any disclaimer, the term of this patent is extended or adjusted under 35 U.S.C. 154(b) by 821 days.

(21) Appl. No.: 13/228,047

(22) Filed: Sep. 8, 2011

(51) Int. Cl.
*C10M 107/38* (2006.01)
*C10N 50/04* (2006.01)

(52) U.S. Cl.
CPC .... *C10M 107/38* (2013.01); *C10M 2213/062* (2013.01); *C10N 2050/04* (2013.01); *C10N 2230/06* (2013.01); *C10N 2250/04* (2013.01); *C10N 2250/12* (2013.01); *C10N 2250/121* (2013.01)

(58) Field of Classification Search
CPC ..... C10N 2250/12; C10N 2250/121
USPC ..... 508/181, 182, 183; 427/427.4, 427.5, 427/427.6
See application file for complete search history.

(56) References Cited

U.S. PATENT DOCUMENTS 4,834,894 A * 5/1989 Scheld ..... 508/183
5,160,646 A * 11/1992 Scheld ..... 508/183
5,223,244 A * 6/1993 Moro ..... A61K 8/046 424/45
5,549,836 A * 8/1996 Moses ..... 508/183
5,562,853 A * 10/1996 Minor ..... C08J 9/149 252/67
5,580,906 A * 12/1996 Merchant ..... C09K 3/30 134/12
5,721,199 A * 2/1998 Moses ..... 508/183
5,766,511 A * 6/1998 Musso et al. ..... 516/8
5,827,446 A * 10/1998 Merchant ..... A62D 1/0057 252/8
5,883,055 A * 3/1999 Baca ..... 508/206
5,902,637 A * 5/1999 Castellano et al. ..... 427/242
6,358,893 B1 * 3/2002 Zechman, III ..... B29C 33/64 427/387
6,521,569 B2 * 2/2003 Abramowski et al. ..... 508/181
6,924,036 B2 * 8/2005 Polastri et al. ..... 428/422
7,593,790 B2 * 9/2009 Valpey, III ..... G06F 17/50 222/635
8,304,068 B2 * 11/2012 Jeon ..... 428/323
2007/0027037 A1 * 2/2007 Easter ..... C10M 105/50 508/181

* cited by examiner

*Primary Examiner* — Ellen M McAvoy
(74) *Attorney, Agent, or Firm* — Banner & Witcoff, Ltd.

(57) ABSTRACT

Methods are provided for reducing noise, sticking, and/or friction using a dry lubricant. The methods provide for application of a friction- and/or noise-reducing composition. The methods reduce friction, and/or noise for multiple applications. The methods also provide for reducing adherence of undesirable materials to articles.

10 Claims, No Drawings

METHODS OF USING A DRY LUBRICANT

BACKGROUND

A variety of lubricants have been used over the years. Lubricant use is particularly widespread in the automobile industry; however, industrial and marine applications also are big consumers of lubricants.

Many types of lubricants are known. Motor oil is particularly well-known for use in lubricating moving parts in automobiles. Similarly, mineral oil is well known as a base for preparing lubricants. Other liquid lubricants include synthetic oils such as polyaklylene glycols (PAG), polyalpha-olefin (PAO), and synthetic esters. Solid lubricants are known; for example, including graphite, hexagonal boron nitride, molybdenum disulfide and tungsten disulfide There is a need in the art for methods of using lubricants to improve the life and/or performance of articles.

SUMMARY

In one aspect, there is a method of reducing friction using a multi-purpose lubricant comprising steps of dispensing from a dispensing device a composition comprising a propellant and polytetrafluoroethylene and applying a first layer of the composition to a first surface.

DETAILED DESCRIPTION

Minimizing friction reduces wear and tear on articles leading to extended use time before the article needs to be repaired or replaced.

In some aspects of the disclosure, methods are provided to administer a lubricant composition capable of providing a lubricating effect to multiple and varied applications in need thereof. Using such a multi-purpose lubricant minimizes the requirement for multiple lubricants.

The lubricant may be dispensed onto a variety of surfaces, including plastic, fiberglass, wood, rubber and glass, as well as metals such as steel, iron, aluminum, and copper.

Advantageously, the lubricant is a dry lubricant; i.e., the propellant components evaporate into the atmosphere in 60 seconds or less after delivery of the PTFE particles to the surface. In some embodiments, the dry lubricant composition comprises a propellant and polytetrafluoroethylene (PTFE). The propellant may contain liquefied petroleum gas, isoparaffinic hydrocarbon, branched heptane, cyclic heptane, and linear heptane, and isopropyl alcohol. See Table 1.

TABLE 1

Components for dry lubricant composition.

| Component | CAS Number |
|---|---|
| liquefied petroleum gas (LPG) | 68476-86-8 |
| isoparaffinic hydrocarbon | 64741-66-8 |
| Heptane | 426260-76-6 |
| Isopropyl alcohol | 67-63-0 |
| Polytetrafluoroethylene (PTFE) | 9002-84-0 |

The composition may be delivered from a delivery device. The delivery device may be any suitable container; for example, the delivery device may be a cylindrical container such as a canister.

In some embodiments, an agitator element is within the delivery device. The agitator element may be spherical, such as a ball, or may be oval-shaped. By shaking the delivery device containing both a lubricant composition and agitator element, the PTFE is evenly distributed throughout the propellant prior to release onto the target surface. In some embodiments, even distribution is obtained by shaking for 30 seconds to 60 seconds. In other embodiments even distribution is obtained by shaking for 45 seconds to 75 seconds. In yet other embodiments, even distribution is obtained by shaking for 60 seconds to 120 seconds. Shaking may be performed by mechanical means or by the user.

Following release from the delivery device, the dispensed lubricant adheres to the target surface and the propellant evaporates leaving behind a PTFE-coated surface. Without being bound by theory, it is believed that the arrival of the PTFE at the target surface in the propellant provides temporary chemical conditions on the target surface that promote adherence of the PTFE particles to the target surface. Frequently, a portion of the energy created by friction is converted into noise. An advantage of the deposited lubricant is reduction of noise arising due to friction.

In some methods of the disclosure, a complete coating is obtained. "Substantially complete coating," as used herein, means that greater than 80% of the target surface area of an article, measured from edge-to-edge of the applied lubricant, is coated with lubricant and that any lubricant-free regions inside the target surface area are less than 0.1 $mm^2$ in size. To obtain a complete coating a user may, for example, spray the lubricant twice over the same surface area with the second spraying at 180° to the first spraying.

In some aspects, an article may have two surfaces, where the second surface is configured to interact with the first surface. In some embodiments, lubricant may be applied to only one surface. In other embodiments, the lubricant may be applied to both surfaces. For example, scissors have two blades that intersect to provide the cutting function. Each of the blades is a surface and lubricant may be applied to either blade or both blades. The first surface and the second surface need not be attached to the same article. Similarly, in a window, having a frame and window pane that is slidable in the window frame, one surface may be the portion of the frame that interacts with the pane and a second surface may be the portion of the pane that interacts with the frame.

In some aspects, it is desirable to obtain the same thickness of lubricant across the target surface area. A uniform lubricant thickness may be obtained by combining a constant dispersal rate while maintaining equal spraying time over any particular portion of the surface area.

Typically, a dispensing device contains a trigger, a nozzle or similar devices to initiate lubricant dispensing. In some embodiments, where even dispersal is not beneficial or required, the nozzle may dispense lubricant in amounts corresponding to the amount of pressure applied to the nozzle. Thus, if the user applies greater pressure to the nozzle then an increasing amount of lubricant is dispensed. In other embodiments, where even dispersal is beneficial, the nozzle may be adapted to regulate lubricant dispensing to facilitate even dispersal of the lubricant by, for example, dispensing lubricant at a constant rate following application of pressure by the user to the nozzle. Such constant rate dispersal nozzles would not provide increased lubricant in response to increased user pressure on the nozzle. Carefully applying a second layer at a 180° angle to the first spraying also promotes uniform thickness of the lubricant across the target surface area.

The multi-purpose lubricant may be used for multiple applications. In some applications friction is reduced. Applications where reducing friction may be achieved include bearings, belts, blades, spindles in bathroom fans, lawn equipment (such as weed trimmers), doors (such as sliding doors and car doors), fans (such as blowers, ceiling fans, stove exhaust fans), gears (such as jack gears, and mixer gears), paper shredders, hinges, joints, latches, levers, lids, lifts, linkages, locks, rollers, runners, screws and bolts, swivels, windows, valves, locks, wheels, or zippers. The lubricant may be used to lubricate bearings; for example, ball bearings in chairs, TV table wheels, or bearings in wheels on boat trailer. Casters on piano legs and wheels of barbecues may also be lubricated. Valves suitable for lubrication include ball valve handlers on sprinklers, manifold heat controls, and toilet shutoff valves.

The lubricant may also be used to reduce or prevent adherence of materials to articles; for example, the lubricant may be applied to lawn equipment such as shovels or lawn mowers to reduce adherence of dirt and grass. Application of a dry lubricant to the top surface of a shovel part that interacts with pebbles, soil, grass, and the like reduces adherence of those materials encountered by the shovel and lawn mower) in their regular use, reducing energy expenditure of the user and reducing time required to clean the article. Similarly, application of a dry lubricant to the bottom surface of a lawn mower, will reduce adherence of cut grass particles to the lawn mower, reducing effort required to mow lawns, as well as reducing the time required to clean the mower and prolonging the lifetime of the lawn mower.

The methods of the disclosure reduce friction by at least 80%, by at least 90%, or by 100%. The methods of the disclosure provide long-lasting lubricating effect. For example, the friction reduction may be between 90% and 100% at 1 month, at 2 months, at 3 months, at 6 months, or at a year.

It is particularly envisaged that arms may be lubricated; for example arms in a dishwasher, window awnings, and control arm bushings on front or rear suspensions of autos. Seat belt buckles and child safety seat buckles may be lubricated.

Lubricating blades to reduce friction is also particularly envisaged. Blades for lubrication include Auger blades, discharge chute of snow blowers, blade-agitator assemblies in food blenders, circular saw, paper cutter, pruning shears, rototiller, spindle in bathroom fans, and weed trimmers.

Lubrication of cables, chains, and wires is also particularly envisaged. Exemplary cable include emergency brake cables, hood releases, helps to insert cables into cable looms, speedometer cables, winch cables, and wires being pulled through a conduit. Exemplary chains include bicycle chains, drive chains on motorcycles, and chains in scrubber machines.

Lubrication of wheels is particularly advantageous. Suitable wheels for lubricant application include retractable wheel wells, baby buggies, chairs, computer cart, crib, dolly, dumpster, hamster play wheel, kitchen bake center, overhead projector cart wheels, rolling book bags, rolling dressers, rolling ping-pong tables, spin wheel on vertical blinds, spinning wheels, wheelbarrow tires, and wheelbarrow wheels.

Joints suitable for lubricating include ball joints, metal joints, moving joints of futon, stand mixers, stock panels, sunshade, tree loppers, vacuum beater bar, and vacuum clear wheel joints. Latch functionality may be improved by lubrication. Suitable latches include auto hood latches, car hood latches, gas cap latches, gate latches, latch mechanisms on snowplows, medicine door, metal latches on chain link fences, stainless steel hood, suitcase, and latches on trunks.

Cranks may be lubricated. For example, suitable cranks include crank arms on windows, hand-operated windows, sunroofs, and trailer supports. Doors may be lubricated. For example, boxcar doors on rail cars, freezer doors, glove compartment, mail box, refrigerator, storm. Handles may be lubricated. For example, handles may be pullout handles on luggage, sewing machine handles, vacuum handle for easy assembly and disassembly, and well cranks. Swivels may be lubricated. Exemplary swivels include swivels on chairs in minivans, picture hangers, rocker legs, snap swivels on dog runs, tv stand swivel mechanisms, vanity mirror swivels, and vertical blind swivels.

The lubricant may also be applied in situations where rust has reduced functionality or to reduce or prevent rust formation. Rust-related applications include bolts on outdoor tv antenna, branch-cutting tools, casters on rolling planters, clean garden tools, keys, lids of jars of canned fruits and vegetables, nuts, screws, and shower doors.

Applications particularly beneficial for reducing squeaking include aging rubber grommets, alternator pulley, automatic sliding seat belts, baby cribs, baby gate lock, bathroom curtain hooks, bed frames, brake cable rubbing against chassis, brake pedal, car fan belts, car hoods, car strut mounts, car trunks, chairs, clutch pedals, doors, fare box levers on city buses, folding animal cages, full-length swivel mirrors, hanging plant holders during wind, locks, metal rocking chair, small kitchen cabinet door hinges, springs, steering wheels, swinging address signs, tail pipe hangers, Tonka trucks, trailer hitch while towing, trash compactor, windows, and windshield wipers.

Applying the dry lubricant to lawn equipment is particularly advantageous in reducing gardening effort and clean-up efforts. Suitable lawn equipment for lubricating may include brake drums, pulley-bearing drive belts, drive pulley of lawnmower blades, external pivots, lawn cart axles, lawn fertilizer spreader gears, lawn spreader, prevent grass and dirt from sticking, pull cord, return springs, speed control cable on power mower, steering mechanism, throttle cables, undercarriages, and zippers on lawn mower grass catcher bags.

Applications particularly beneficial for reducing sticking include asphalt from dump truck bed, blinds, bottoms of storage containers sticking to shelves, bugs, tar and dirt onto car bumpers, car door during cold weather, doorknobs for smooth operation, drawers, gas shutoff valve, intercom buttons on apartment security systems, knobs on adjustable chairs, medicine cabinet closure, old drawer-type broiler, painted radiator valves, refrigerator door gasket, snow onto satellite dishes, snow onto shovel, trash can lids, trigger on glue gun, and zippers on outdoor umbrella covers.

Particular hinge applications include hinges on alarm boxes, swing doors, bird houses, car doors, closet doors, metal boxes, oven doors, self-closing patio doors, piano benches, piano lids, plate holders, pruning shears, small kitchen cabinet door, storm doors, and TV cabinet doors. Applications also include lifts such as hydraulic lifts on truck bed cover, hydraulic tailgate, and pneumatic doors.

Locks may be lubricated to improve ease of use; for examples the locks may be on barn doors, car doors, dead bolt locks, dog kennels, double glazing mechanisms on window locks, French door, gas cap, gate, glove box lock, luggage, or on a patio door.

Screws and bolt may also be lubricated to improve ease of use. Exemplary screws and bolts include license plate bolts and screws, bolts on mail boxes, Christmas tree holder, patio furniture, wood screws for easer installation.

Additional particular examples suitable for lubrication include: adjuster button on canes, air nozzle caps on tires, aluminum blind stoppers, antique irons, area under the hook of a sewing machine, baby swings, cabinet hardware, car antenna, cargo release systems, cargo straps on semi trucks, chain saws, clothesline retractor, connectors on antique stove for easy assembly, covering air vent on covering dryers, curtain rods, draw heads on railroad boxcars, eases disassembly of hammock supports, fasteners, folding metal stool, folding parts of ironing, forklifts, farm equipment, harvesters, tractors, garden hose trigger nozzle, garden tools, garden windmills, gardening shears, gauges, gun carriages, guns, heavy-duty cutting heads, hedge trimmers, helps to open lock boxes on home that have swollen from the heat, hose winder, drill bits, kennel gate, key holes, limbs of christmas trees, pulleys on cable-operated bulldozers, mailboxes, mail carts, metal patio chairs, motors, mounting bracket for alternator, mouse trap machinery, moving parts of vacuum motor, needles on knitting machine, old printing presses, playground equipment, rear shock absorbers, rollerblade, roof ventilation turbines, rotating spice racks, slide-out attic ladders, small rolling toys, snow blowers, socket wrench, springs, stops belt noise on automobiles, storage drawer at bottom of stove, sun visors, swinging leg rests on wheel chairs, table leafs, tire jack, tools, torsion bars, trailer hitch, trailers, umbrella poles, vacuum cleaner roller brush, vice grips, weed eater, wind-driven attic turbo vents, adjusting mechanisms on chairs, ergo chairs, shower door, storage shed door, conveyor belt rollers, porch glider runners, recliner runners, screen runners, lids of washers and dryers, emergency brake releases, throttle, toilet handle linkage, brake levers on wheelchairs, chokes, gas caps, heat register vents, razor scrapers, windsocks.

The methods of the disclosure provide reduced friction at a wide range of temperatures. Thus, the lubricant may be used in applications exposed to extreme temperatures. For example, the lubricant reduces friction in applications exposed to a temperature range of −100° C. to −50° C., −50° C. to 0° C., at 0° C. to 50° C., 50° C. to 100° C., or 100° C. to 500° C.

While particular embodiments have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A method of reducing friction using a dry lubricant comprising steps of a) dispensing from a dispensing device a composition consisting essentially of polytetrafluoroethylene, liquefied petroleum gas (LPG), isoparaffinic hydrocarbon, heptane, and isopropyl alcohol, and b) applying a first layer of the composition to a first surface of a target surface area; wherein the dry lubricant reduces friction when applied to a surface of an article selected from the group consisting of: a zipper a garden tool, a stove, a table, a piano, a sprinkler, a toilet, a dishwasher, a window awning, a snow blower, a food blender, a saw, a paper cutter or paper shredder, a bicycle chain, a baby buggy, a cart, a crib, a gate, a dolly, a dumpster, a bathroom fan, a luggage article, a blind, a futon, a stand mixer, a stock panel, a vacuum, a fence, a mailbox, a refrigerator or freezer, a picture hanger, a dog run, a rocking chair, a mirror, a TV antenna, a caster, a key or key hole, a jar lid, a sliding door, a curtain, a bed frame, a fare box, a cage, a plant bolder, a cabinet, a sign, a toy, a trailer or trailer hitch, a truck bed, a storage container, a knob, a drawer, a button, a broiler, a satellite dish, a trash compactor or trash can, a glue gun, an umbrella or umbrella cover, a cane, a sewing machine or knitting machine, a swing, a clothesline retractor, a dryer, a folding part, a windmill, a gun or gun carriage, a cutting head, a lock box, a drill bit, a mouse trap, a playground, a rollerblade, a vent, a rotating spice rack, a ladder, a hand tool, a sun visor, a wheel chair, a tire jack, a conveyor belt roller, a runner, a scraper, and a windsock.

2. The method of claim 1 further comprising applying a second layer of the composition to the first surface.

3. The method of claim 1 further comprising applying a first layer of the composition to a second surface configured to interact with the first surface.

4. The method of claim 3 further comprising applying a second layer of the composition to the second surface.

5. The method of claim 1 wherein the heptane is branched heptane, cyclic heptane, or linear heptane.

6. The method of claim 1 wherein the dispensing device is a canister.

7. The method of claim 6 wherein the canister further comprises an agitator element.

8. The method of claim 7 wherein the agitator element is a sphere.

9. A method of reducing adherence of materials using a dry lubricant comprising steps of a) dispensing from a dispensing device a composition consisting essentially of polytetrafluoroethylene, liquefied petroleum gas (LPG), isoparaffinic hydrocarbon, heptane, and isopropyl alcohol, and b) applying a first layer of the composition to a surface of one of a shovel and a lawn mower to reduce adherence of materials.

10. The method of claim 1, wherein the garden tool is selected from the group consisting of a wheelbarrow, a blower, a branch-cutting tool, a rototiller, a shovel, a hose, a hose nozzle, a hose winder, a gardening shear, a hedge trimmer, and a weed eater.

* * * * *